US009204739B2

(12) United States Patent
Van Buskirk

(10) Patent No.: US 9,204,739 B2
(45) Date of Patent: Dec. 8, 2015

(54) APPARATUS AND METHOD FOR PRODUCT DISPLAY

(71) Applicant: The Marco Company, Fort Worth, TX (US)

(72) Inventor: Joel Van Buskirk, Kennedale, TX (US)

(73) Assignee: THE MARCO COMPANY, Fort Worth, TX (US)

( * ) Notice: Subject to any disclaimer, the term of this patent is extended or adjusted under 35 U.S.C. 154(b) by 188 days.

(21) Appl. No.: 13/943,442

(22) Filed: Jul. 16, 2013

(65) Prior Publication Data

US 2015/0020361 A1 Jan. 22, 2015

(51) Int. Cl.

| | |
|---|---|
| ***A47F 5/00*** | (2006.01) |
| ***A47F 5/16*** | (2006.01) |
| ***A47F 5/12*** | (2006.01) |

(52) U.S. Cl.

CPC ... *A47F 5/16* (2013.01); *A47F 5/12* (2013.01); *A47F 2005/165* (2013.01); *Y10T 29/49826* (2015.01); *Y10T 29/49895* (2015.01); *Y10T 29/49899* (2015.01); *Y10T 29/49901* (2015.01); *Y10T 29/49904* (2015.01)

(58) Field of Classification Search

CPC ..... A47F 5/16; A47F 5/12; A47F 2005/165; Y10T 29/49904; Y10T 29/49895; Y10T 29/49899; Y10T 29/49901; Y10T 29/49826

See application file for complete search history.

(56) References Cited

U.S. PATENT DOCUMENTS

| | | | | |
|---|---|---|---|---|
| 3,355,054 | A * | 11/1967 | Wilson | 220/23.6 |
| 3,570,679 | A * | 3/1971 | Edson | 211/47 |
| 5,165,755 | A * | 11/1992 | Rho | 297/344.18 |
| D398,198 | S * | 9/1998 | Sanders | D7/701 |

OTHER PUBLICATIONS

SPG International, LLC http://www.chefgeneral.com/p/5409.htm.*

* cited by examiner

*Primary Examiner* — John C Hong

(74) *Attorney, Agent, or Firm* — Yee & Associates, P.C.

(57) ABSTRACT

An apparatus and method to retain a product support, displaying the product in a container, in adjustment panels mounted to a frame. Each adjustment panel may mount to the frame at a particular inclination angle, and include a number of serpentine slots for engaging a number of support pins extending from sides of the product support. Each serpentine slot in the number of serpentine slots may include a notch at each end, and at each direction change, of the serpentine slot. Each notch in a particular serpentine slot may be a different distance from a top edge of its respective adjustment panel. A first product support may be retained in a notch such that a top edge of a first container with a first depth on a first product support is substantially level with a top edge of a second container of a second depth on a second product support.

12 Claims, 7 Drawing Sheets

APPARATUS AND METHOD FOR PRODUCT DISPLAY

BACKGROUND INFORMATION

1. Field

The present disclosure relates generally to product display. More particularly the present disclosure relates stocking and displaying a variety of products on a display stand.

2. Background

Merchants have a need for an apparatus or method to transport a product to a display stand, and to stock and restock the display stand with the product. A product may mean various products of different sizes and weights. Some products have a size or weight that makes carrying them from a storage location to a display difficult. The greater distance that a product is stored from the display stand, the greater the difficulties in transporting, stocking, and restocking become. Certain industries may have developed product transport containers of various standard sizes. As an example, some produce may be transported in reusable plastic containers with depths of 8, 11, 13, 16, or 19 centimeters. Currently, a display stand may not be designed to accommodate industry standard shipping containers, or not designed to accommodate more than one size container, or to accommodate more than one size container simultaneously. Current tools and techniques for loading product or containers onto a display stand may result in damage to the product or display stand, or injury during the loading.

It may be desirable to have a stand able to easily stock and attractively display a product in a container that can be used for transporting the product. Such a combined use may save stocking time, and reduce the likelihood of injury to a stocker, or damage to the products or the display stand. Accordingly, it would be advantageous to have an apparatus or method that takes into account one or more of the issues discussed above as well as possibly other issues.

SUMMARY

The different advantageous embodiments provide an apparatus to retain a product support as a method of displaying a product. The features, functions, and advantages can be achieved independently in various embodiments of the present disclosure or may be combined in yet other embodiments in which further details can be seen with reference to the following description and drawings.

In one advantageous embodiment, an apparatus may include adjustment panels connected to a frame to retain the product support, and configured such that when a first container and a second container having different depths are on a first product support and a second product support respectively, first product support and the second product support each engage both the first adjustment panel and the second adjustment panel, such that a top edge of the first container on the first product support may be substantially level with a top edge of the second container on the second product support.

The first adjustment panel and the second adjustment panel may be substantially parallel to each other and configured with a lower edge of each respective adjustment panel at an inclination angle, relative to horizontal, that is similar for each adjustment panel.

Each adjustment panel may be configured to include at least a first notch and a second notch in a first slot, and a corresponding first notch and a corresponding second notch in a second slot. The first slot and the second slot each may be configured to: engage the first product support such that the first notch and the corresponding first notch retain the first product support, facilitate sliding the first product support to the second notch and the corresponding second notch, and retain the first product support in the second notch and the corresponding second notch.

Each adjustment panel may have a cap that may cover a top side of a selected adjustment panel. The cap may be configured to: support a product container, facilitate sliding the product container onto the support panel connected to the product support, and retard deformation to the adjustment panel.

Each slot may be a serpentine slot. Each serpentine slot may include one notch at each end of the serpentine slot, and a notch at each point of direction change of the serpentine slot.

A first distance from a top edge of the first adjustment panel to the first notch may correspond to a first standard depth for the first container and a second distance from the top edge of the first adjustment panel to the second notch may correspond to a second standard depth for the first container. Each adjustment panel further may comprise at least two serpentine slots. Each serpentine slot may extend across a width of the adjustment panel, and include a notch for retaining a support pin extending from the product support.

A front panel may connect to a front side of the frame, the front panel including a top rail, and a planar side. The top rail may be reinforced to support a product container, and configured to facilitate sliding the product container onto the product support.

The frame may be configured such that a front side of the frame includes: a front top cross rail that is substantially parallel to a front base cross rail, a front left post and a front right post.

The frame may have a rear side that includes a rear left post and a rear right post, each rear post connected to a rear cross rail that may be configured substantially parallel to the front top cross rail and substantially perpendicular to each rear post.

The frame may also include a right base cross beam, a right central cross beam, and a right top cross beam, each top cross beam may be configured with identical cuts at the inclination angle. A front end of each central and top cross beam may be connected flush against a respective front post while the respective cross beam rises at the inclination angle to connect a rear end of the respective cross beam flush against a respective rear angle brace.

The frame may also include a rear left angle brace, a rear center angle brace, and a rear right angle brace, each rear angle brace configured with a rear post end and a top end, such that each rear post end is cut identically at the inclination angle, and further wherein a rear post end of rear left angle brace connects flush on top of a rear left post and extends upward at the inclination angle toward the front side. The rear post end of the rear right angle brace may connect flush on top of the rear right post and extends upward at the inclination angle toward the front side, the rear post end of the rear center angle brace connects flush to a top side of the rear cross rail.

Each product support may comprise a rectangular shape including a front length tube, a rear length tube, a left side tube, a right side tube, and a grip tube. Each product support may include a lip that may extend upward along the front length tube, a length of the lip being less than the length of the front length tube, and configured such that each end of the length of the lip may be recessed from a respective end of the length of the product support.

A support panel may be connected to the product support. A support panel may include a panel configured to a rectangular dimension equal to the product support, at least two grip openings configured through the panel, and a drainage opening near a length side of the panel closest to the front length tube.

In another advantageous embodiment, a method may be present for displaying a product in a frame in a number of containers, wherein each container of the number of containers may have a different depth, such that none of the number of containers contact each other, and a top edge of each of the number of containers may be substantially level with the top edge of each of all other containers in the number of containers.

The method may include supporting at least two adjustment panels, manufacturing a product support, and attaching a support pin onto the product support, such that the support pin extends from a side tube of the product support.

The method may include forming a support panel with a first opening configured to allow a human finger to pass through the support panel, and a second opening configured to drain fluid from the support panel, and attaching the support panel to the product support.

The method may include forming an adjustment panel, such that the adjustment panel may include a number of serpentine slots and a number of notches in each serpentine slot, and engaging the support pin into a notch among the number of notches, and sliding the support pin in the serpentine slot to engage in a particular notch.

In yet another advantageous embodiment, a method may be present for displaying a product, including selecting a desired display angle for a product support, selecting a desired display height for the product support, and producing an adjustment panel, the adjustment panel may be configured based upon the desired display angle, and include at least two serpentine slots. Each serpentine slot each may include at least two notches. Each notch may be configured to retain a support pin extending from the product support.

The method may include connecting the adjustment panel to a frame, connecting a weld end of the support pin to a side tube of the product support such that an engagement end of the support pin extends outward from the side tube, and connecting a support panel to the product support.

The method may also include receiving the engagement end of a first support pin into a first serpentine slot in a first adjustment panel and receiving a second support pin into a second serpentine slot, the second serpentine slot being on the first adjustment panel and adjacent to the first serpentine slot.

The method may include, subsequent to receiving the second support pin, receiving a third support pin into a third serpentine slot, the third serpentine slot may be on a second adjustment panel, and receiving a fourth support pin into a fourth serpentine slot, the fourth serpentine slot being on the second adjustment panel and adjacent to the third serpentine slot; receiving each support pin into a respective notch in its respective serpentine slot, each respective notch may correspond to the desired display height for the product support; and receiving the product on the support panel.

The method may include producing a cart, the cart may be a rectangular shape. The cart may be configured to receive, from a first side of the cart, a product container onto a planar surface connected to a top side of the cart, the first side may define a length of the rectangular shape. The cart may include, on each of the three remaining sides of the cart, a container retention lip extending vertically upward above the planar surface, and configuring the cart to transport the product container from a storage area to the frame.

The method may include attaching a mobility system and a braking system to the cart. The mobility system may include a caster, the braking system may include a caster brake.

The method may also include forming each serpentine slot such that it may include at least five notches. Each of the five notches may retain the product support at five different distances respectively from a top edge of the adjustment panel.

The desired display angle may determine an inclination angle. The inclination angle may guide cutting and mounting the adjustment panel and a respective front end identically cut, for each of: a center central cross beam, a center top cross beam, a left central cross beam, a right central cross beam, a left top cross beam, and a right top cross beam as well as a respective rear post end, identically cut, for each of: a rear center angle brace, a rear left angle brace, and a rear right angle brace.

The method may also include spacing apart the first adjustment panel and the second adjustment panel such that a distance between the first adjustment panel and the second adjustment panel may accommodate inserting a standard sized produce plastic container onto the product support engaging the first adjustment panel and the second adjustment panel. Each adjustment panel may be covered with a cap. The cap may include plastic wood.

The method may include cutting openings in each support panel. The openings may include at least two openings that may allow fingers to pass through the openings to engage a grip tube of the product support beneath the support panel, a drainage opening near a length side of the panel closest to a front side of the frame.

The method may also include attaching a stem leveler/glide foot to a post that is part of the frame. The stem leveler/glide may be attached to an end of the post that is nearest a floor that the frame stands on.

BRIEF DESCRIPTION OF THE DRAWINGS

The novel features believed characteristic of the advantageous embodiments are set forth in the appended claims. The advantageous embodiments, however, as well as a preferred mode of use, further objectives and advantages thereof, will best be understood by reference to the following detailed description of an advantageous embodiment of the present disclosure when read in conjunction with the accompanying drawings, wherein:

DETAILED DESCRIPTION

Figure 1:
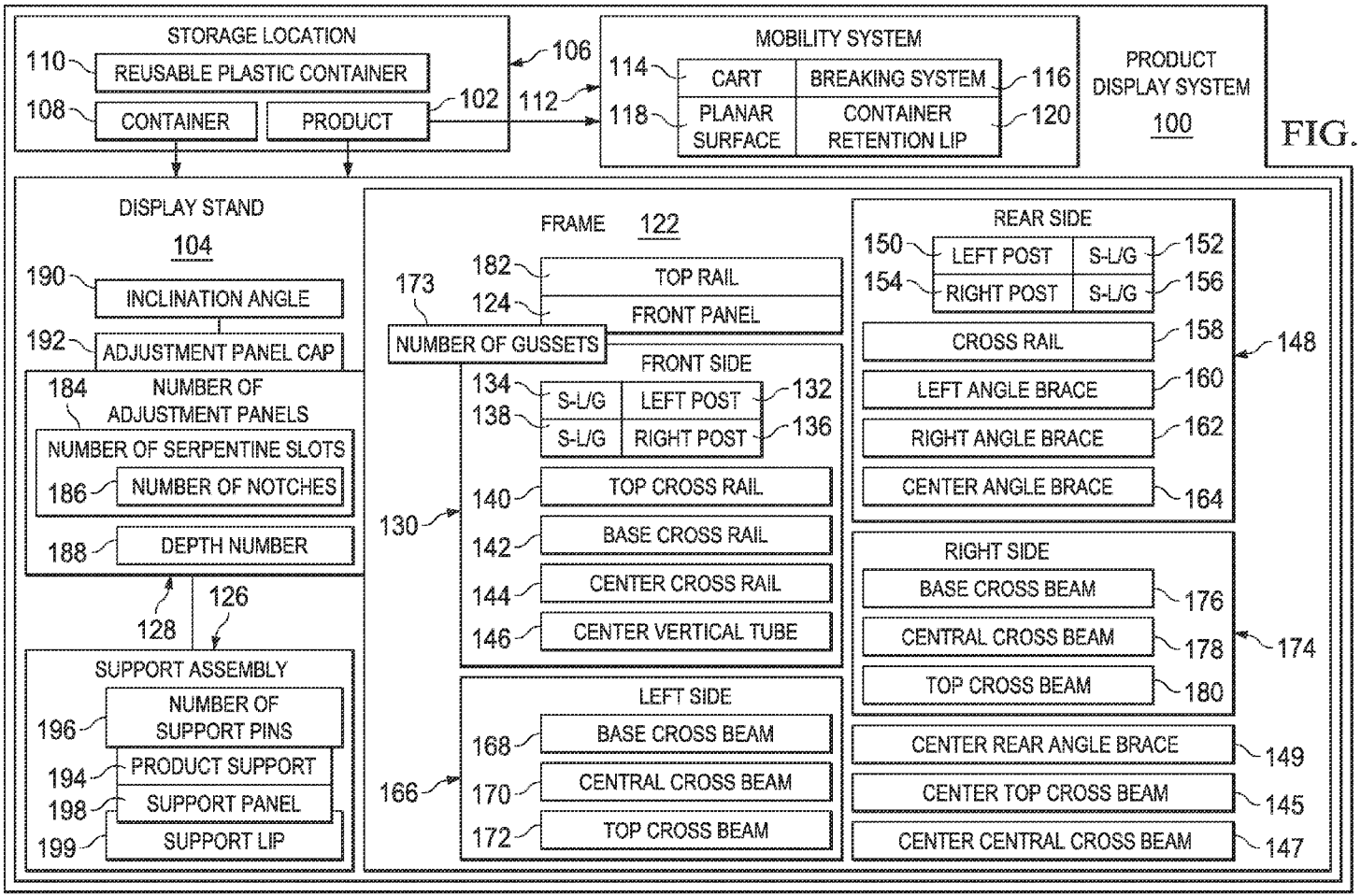
FIG. 1 is an illustration of a block diagram of a product display system in accordance with an illustrative embodiment.

It may be desirable to use a particular display stand to stock different types of merchandise simultaneously or to stock different types of merchandise on the particular display stand at different times. As an example a single display stand may contain grapes, parsley, watermelons, and juicer machines. Merchants may have a need for an apparatus or method for stocking and restocking a display stand with various products in various size containers in a manner that uses minimal time while also minimizing a risk of injury to a stocker, or damage to the products, the product containers, or to the display stand.

Current display stands may provide a display shelf at a single level, which makes displaying different sized products, or fitting different sized product containers onto a single level shelf a difficult or undoable task. Currently, if a larger product is to be added to a display shelf, it may be necessary to take all the items off the shelf, remove the shelf from the display rack, and then reinsert the shelf at a new level on the display rack and reload all the items back on to the shelf. Current display stands that are flat and wide also present difficulty for a stocker to load, or a customer to retrieve items from a far side of the stand. Products located on a far side of a wide stand, particularly if the product is heavy, can cause difficulty or injury to a stocker or consumer loading or retrieving the product, or cause damage to other products on the stand.

Additionally, the edge or frame of a product display stand is often used as a brace, lever, or stand for loading or retrieving a product, or a container of products. Such uses cause wear and tear, or even deformation or failure of current display stands.

When the product requires a cooling medium, the difficulties may increase. A product requiring a cooling medium can add difficulties for transporting, sustaining, and disposing of the cooling medium. Providing electricity to support product cooling can be problematic or prohibitive. A cooling medium may be as simple as a bin filled with ice. A cooling medium can result in condensation, leakage, or melting problems that require a drainage system. Current display caster 222 for dry products may lack the ability to properly display products that require a cooling medium. Failure to provide for a required cooling medium can result in spoiled product as well as displays that are not sturdy, not durable, or do not provide optimal presentation of the product.

It would be helpful to have an apparatus or method to assist transporting products to a display stand in varying sizes of containers. It would be helpful to have an apparatus, or method able to stow a supply of restock products near a display. It would be helpful to have an apparatus, or method to assist loading products or product containers into a display. It may be desirable to have a stand able to easily stock and attractively display a product in a container that can be used for transporting the product. Such a combined use may save stocking time, and reduce the likelihood of injury to a stocker, or damage to the products or the display stand. It would be helpful to have an apparatus, or method that enables quick adjustment of a display stand to enhance display of products, and to overcome the above mentioned and other needs.

Figure 2:
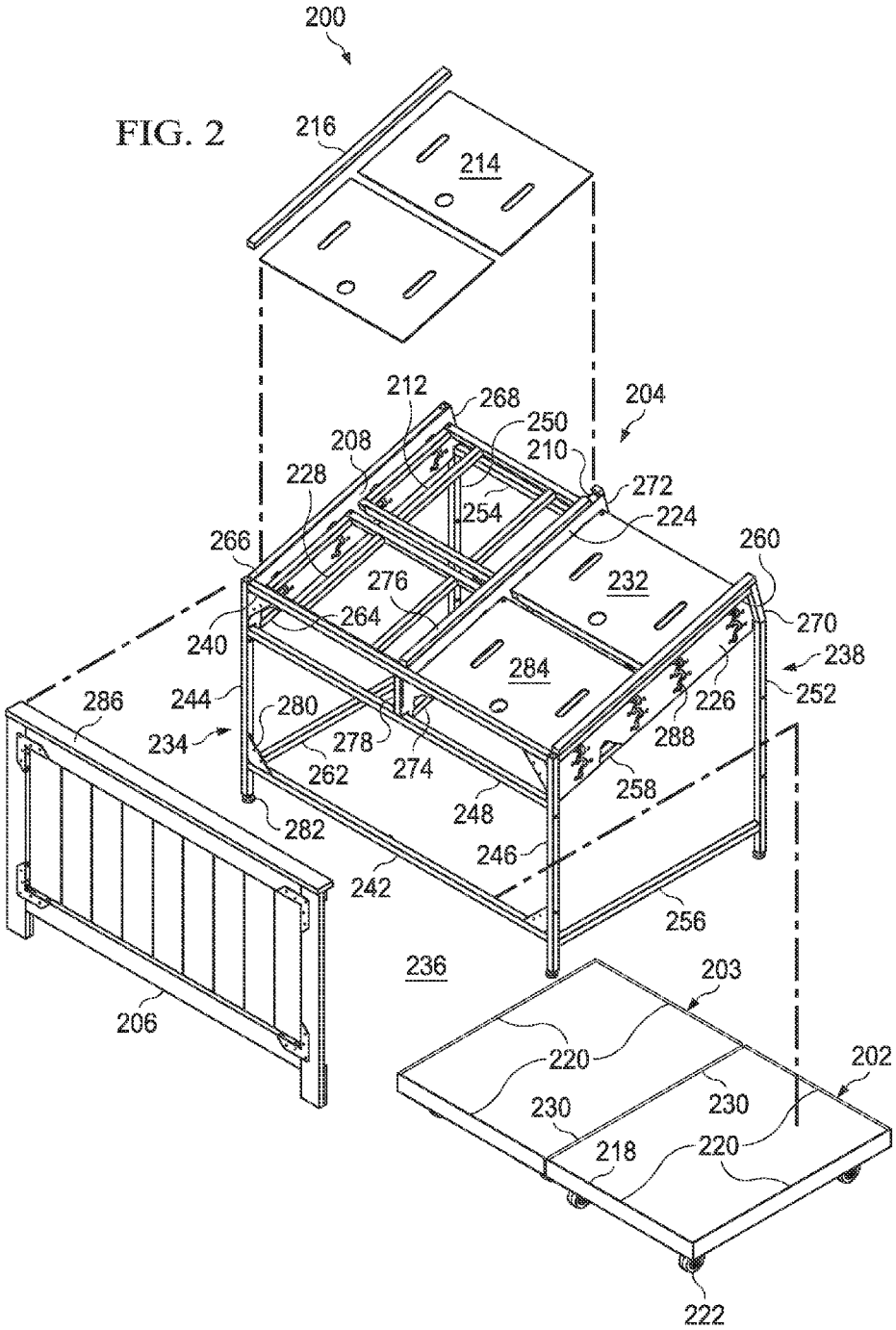
FIG. 2 is an exploded perspective view illustration of a product display system in accordance with an advantageous embodiment.

Referring more particularly to the drawings, embodiments of the disclosure may be described in the context of a product display system 100 as shown in FIG. 1 and a product display 200 as shown in FIG. 2.

Turning first to FIG. 1, FIG. 1 is an illustration of a block diagram of a product display system in accordance with an illustrative embodiment. Product display system 100 is configured to accept product 102 from a location away from display stand 104, which may be storage location 106, and move the product 102 to display stand 104. Product may be stored, transported and displayed in container 108. Container 108 may be an industry standard sized reusable plastic container 110

Product 102 may be loaded onto a mobility system 112, which may be cart 114. Mobility system 108 may have a braking system 116. Cart 114 may include planar surface 118 with container retention lip 120 around three sides of cart 114. Container retention lip 120 on three sides of cart 114 may facilitate loading container 108 onto cart 114 and transporting cart 114 to display stand 104.

Display stand 104 may include frame 122, front panel 124 and support assembly 126. Front panel may attach to frame 122. Support assembly 126 may be inserted, set to adjustable heights, and removed from frame 122 via number of adjustment panels 128.

Frame 122 may include: front side 130, rear side 132, right side 134, and left side 136. At least two adjustment panels from the number of adjustment panels 128 may be attached to frame 122.

Front side 130 may include: front left post 132 and connected stem leveler/glide 134, front right post 136 and connected stem leveler/glide 138, front top cross rail 140, front base cross rail 142, front central cross rail 144, and front center vertical tube 146. Each stem leveler/glide may be adjusted to adjust a height of the respective post. Left side 166 may include: left base cross beam 168, left center cross beam 170, left top cross beam 172, and number of gussets 173 configured to stabilize the front side.

Rear side 148 may include: rear left post 150 and connected stem leveler/glide 152, rear right post 154 and connected stem leveler/glide 156, rear cross rail 158, rear left angle brace 160, rear right angle brace 162, and rear center angle brace 164. Each stem leveler/glide may be adjusted to adjust a height of the respective post. Right side 174 may include: right base cross beam 176, right central cross beam 178, and right top cross beam 180.

Front panel 124 may be connected to front side 130 via number of gussets 173. Top rail 182 may be connected to top length of front panel 124. Top rail 182 may facilitate loading container 108 onto frame 122.

Number of adjustment panels 128 may each be configured with a number of serpentine slots 184. Each serpentine slot in the number of serpentine slots 184 may have a number of notches 186, with a labeled depth number 188 marked or engraved adjacent to the each notch. Number of adjustment panels 128 may each be connected to frame 122 at a similar inclination angle 190. Adjustment panel cap 192 may be connected atop each of the number of adjustment panels 128.

Number of adjustment panels may also connect to center top cross beam 145, center central cross beam 147, and front center vertical tube 146. Center top cross beam 145 and center central cross beam 147 may connect to rear center angle brace 149, and to front top cross rail 140 and front central cross rail 144.

Number of adjustment panels 128 may be configured to receive support assembly 126. Support assembly 126 may include product support 194 with connected number of support pins 196, and covered with support panel 198. A front edge of support assembly 126 has support lip 199 extending orthogonally upward above support panel 198. Support lip 199 may function to provide separation between containers loaded onto adjacent support assemblies.

The illustration of product display system 100 in FIG. 1 is not meant to imply physical or architectural limitations to the manner in which an illustrative embodiment may be implemented. Other components in addition to or in place of the ones illustrated may be used. Some components may be unnecessary. Also, the blocks are presented to illustrate some functional components. One or more of these blocks may be combined, divided, or combined and divided into different blocks when implemented in an illustrative embodiment. Alternative examples may have alternatives to those described and still be within the scope of one or more illustrative embodiments.

Turning now to FIG. 2, an exploded perspective view illustration of product display system 200 is depicted in accordance with an advantageous embodiment.

Product display system 200 is a system that may be used to display a product (not shown). A product may mean various products of different sizes and weights. As a non-limiting example, the product may be an item of produce such as a fruit or a vegetable. The product may include an item for preparing produce for consumption, or any other item that might be offered for sale.

In an illustrative embodiment, product display system may include cart 202, frame 204, front panel 206, at least two adjustment panels 208 and 210, product support 212, support panel 214, and adjustment panel cap 216.

In this illustrative example, cart 202 may be an example of one implementation of cart 114 in FIG. 1. Cart 202 may be a rectangular shape. Cart 202 may be of a size that allows it to fit under frame 204. In another illustrative embodiment, cart 202 may be of a size that allows two or more carts 202 and 203 to be adjacently aligned and fit under frame 204. Cart 202 may be formed of tubing. The tubing may be of a durable material with weight baring characteristics sufficient to support any product cart 202 will be used to transport to frame 204. In a non-limiting example, the tubing may be of a metal or of a composite material. In a non-limiting example, seven tubes of one-inch square tubing (not shown) may be used to form cart 202. Two tubes may each be 32½ inches and define a length side of cart 202. Five other tubes may each be 22 inches long, and each connected, substantially parallel to each other, and substantially perpendicular to the two tubes defining the length side of cart 202, to the two tubes defining the length of cart 202. Cart 202 planar surface 218 may be connected on top of the connected tubes forming cart 202. Cart 202 planar surface 218 may be of a durable material with weight baring characteristics sufficient to support any product cart 202 will be used to transport to frame 204. In a non-limiting example, cart 202 planar surface 218 may be of a metal or of a composite. Cart 202 planar surface 218 may be a plastic, such as but not limited to a 3/16 of an inch thick acrylonitrile butadiene styrene sheet.

Still addressing illustrative embodiments of cart 202, container retention lip 220 may extend vertically upward above the planar surface 218 around three sides of cart 202. In this illustrative example, container retention lip 220 may be an example of one implementation of container retention lip 120 in FIG. 1. Container retention lip 220 may extend 13/16 of an inch above a top surface of cart 202 planar surface 218. Container retention lip 220 may be 2 inches wide. Container retention lip 220 may include a sheet of 16 gauge metal. Container retention lip 220 may be formed from two 24 1/16 inch sheets and a 32½ inch sheet. Length side 230 of cart 202 may have no container retention lip 220.

Cart 202 may include a mobility system 112 and a braking system 116. Cart 202 mobility system 112 may include caster 222 mounted near each corner of cart 202. Caster 222 may be a 3 inch diameter swivel plate caster. Caster 222 may be mounted to a mount plate (not shown) with fasteners (not shown). The fasteners may be ¼-20 hex nuts, ¼-20 by ¾ inch hex head bolts, and washers with an inner diameter of 5/16 inch and an outer diameter of ¾ inch. The mount plate may be a light weight and durable material. The mount plate may be 3¾ inches by 5 inches. The mount plate may include 12 gauge aluminum. The mount plate may be connected to cart tubes (not shown). Cart 202 braking system 116 may include a caster brake (not shown). The cart 202 mobility system may facilitate moving cart 202 from a storage area to frame 204.

In operation, container retention lip 220 helps prevent a product container (not shown) on cart 202 from sliding and moving over an edge of cart 202, and falling off cart 202, particularly when cart 202 is in motion transporting the product from a storage area to frame 204. A product container may be any device containing product for display. A product container may be used for transporting, storing, and displaying a product. A product container may be of various dimensions, depths, and materials. In an illustrative embodiment, a product container may be a reusable plastic container. Reusable plastic containers may have standard sizes and standard depths. As a non-limiting example, reusable plastic containers for produce may have depths of 8, 11, 13, 16, and 19 centimeters.

The container may be set onto cart 202 planar surface 218 from cart 202 length side 230 without container retention lip 220, and then slid into position on cart 202 planar surface 218 until container retention lip 220 stops the container from sliding off the cart 202. Containers may be stacked on top of one another on cart 202. Some containers may be formed with edges, tops, or bottoms to engage and stack with other containers. When cart 202 is at a location such as near frame 204 or a storage area, and needs to be unloaded, containers can be slide off cart 202 along cart 202 length side 230 without container retention lip 220.

Cart 202 and 203 may be stored together, such as within the base of frame 204. Cart 202 and 203 may be placed such that cart length side 230 without container retention lip 220, of each cart 202 and 203 may abut each other so that the full circumferential exterior edge of the larger rectangle formed by the two carts 202 and 203 adjacently together has container retention lip 220 that helps keep containers from being moved off either cart 202 or 203. Alternatively, cart 202 and/or 203 length side 230 without container retention lip 220 may be placed facing out to an edge of frame 204 such that sliding a container onto or off of cart 202 will not be impeded by container retention lip 220.

In this illustrative example, frame 204 may be an example of one implementation of frame 122 in FIG. 1. Frame 204 may include numerous pieces of framing material connected to hold a product support 212 in adjustment panels 208 and 210. In this illustrative example, product support 212 may be an example of one implementation of product support 194 in FIG. 1.

Figure 5:
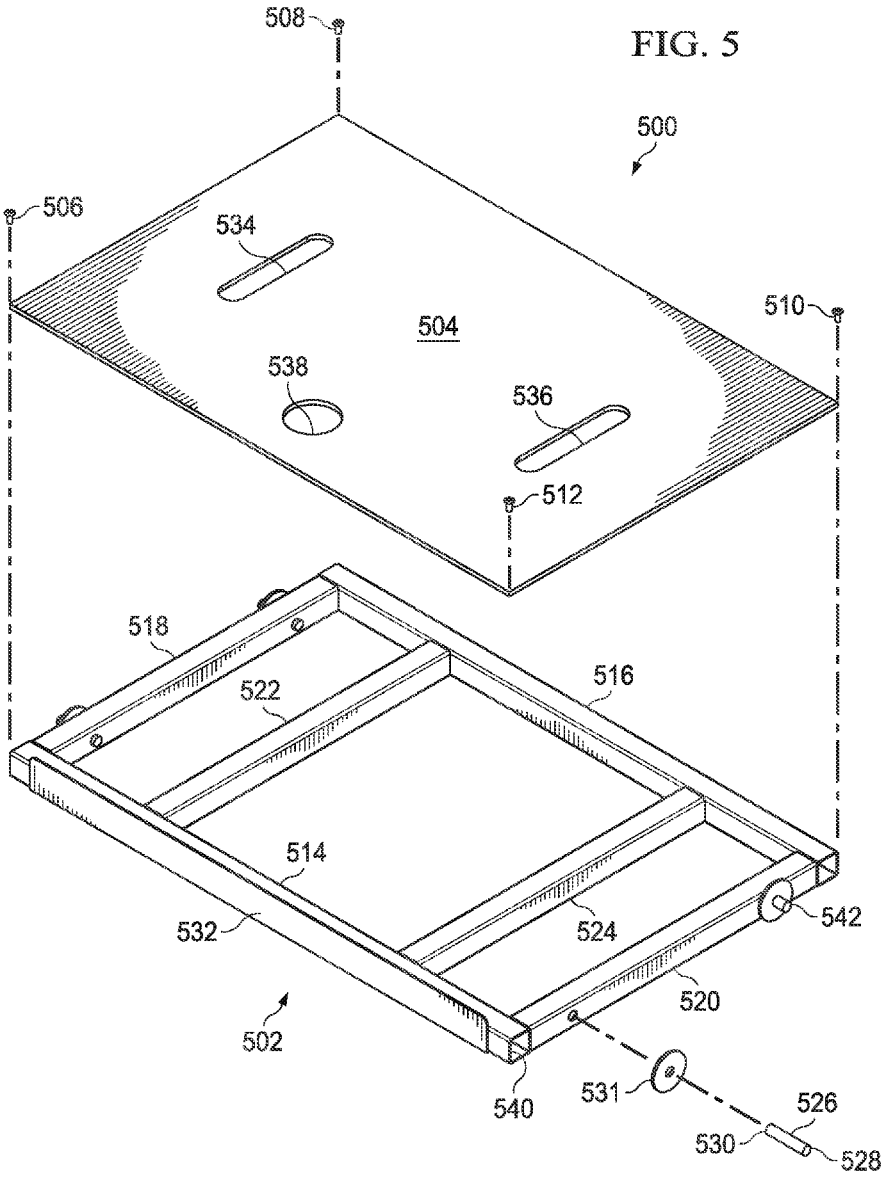
FIG. 5 is an exploded perspective view illustration of a support assembly in accordance with an advantageous embodiment.

In frame 204 shown in FIG. 2, four adjustment panels 208, 210, 224, and 226 may be used to hold four different product supports (212 and 228 are shown), two additional product supports are located beneath support panel 232 and 284 respectively, as shown in further detail in FIG. 5). Any of the numerous pieces that may be used in forming frame 204, may be constructed of, unless specified otherwise, any material that may have sufficient strength to provide support for any product frame 204 will be used to display. In other illustrative embodiments, frame 204 construction can be modified to hold a number of product supports which is greater or lesser than four.

Frame 204 may include: front side 234 that may rise substantially perpendicular to floor 236 frame 204 stands upon, to a first height; rear side 238 that may rise, substantially perpendicular to floor 236 that frame 204 stands on, to a second height that may be above the first height. Front side 234 may be connected to rear side 238 by beams.

In this illustrative example, front side 234 may be an example of one implementation of front side 130 in FIG. 1.

Front side 234 may be formed including front top cross rail 240, which may be substantially parallel to front central cross rail 248, and front base cross rail 242. Front central cross rail 248 may be of a material, dimension, and length that may be equal to front top cross rail 248 and front base cross rail 242. Each rail may be formed of one-inch square tubing, and may each be 49 3/16 inches long. Front side 234 may also include front left post 244 and front right post 246, each connected respectively to a first end and a second end of each of front top cross rail 240, front central cross rail 248, and front base cross rail 242.

In this illustrative example, front left post 244, front right post 246, front top cross rail 240, front central cross rail 248, and front base cross rail 242 may be examples of one implementation of front left post 132, front right post 136, front top cross rail 140, front central cross rail 144, and front base cross rail 142 in FIG. 1. Front left post 244 and front right post 246 may be one-inch square tubing, and may each be 49 3/16 inches long. 30 7/16 inches long.

Each post may include a stem leveler/glide 282. In this illustrative example, stem leveler/glide 282 may be an example of one implementation of stem leveler/glide 134, 138, 152, and 156 in FIG. 1. A glide portion of the stem leveler/glide 282 may have a diameter of 1 1/2 inches. The stem may have a length of 3/8 inch. The stem leveler/glide 282 may connect to a weld nut (not shown). The weld nut may be a 3/8 inch 16 National Course weld nut. The National Course weld nut may connect to an inside edge of any particular post on the edge that is closest to any cross rail connected to the particular post, such that an outer perimeter of the stem leveler/glide 282 does not extend beyond an outer edge of any post the stem leveler/glide 282 in a manner that may cause overlapping stem leveler/glides from interfering with placing frame 204 directly abutting an adjacent frame. Stem leveler/glide 282 may be welded to the inside edge of the particular post.

Gusset 280 may reinforce connections of respective front posts to front top cross rail 240 and front base cross rail 242 at each interior corner of front side 234. In this illustrative example, gusset 280 may be an example of one implementation of number of gussets 173 in FIG. 1. Each gusset 280 may include 12 gauge sheet metal. Each gusset 280 may have a modified right triangle shape with a hypotenuse of 5.66 inches, and may have a snipped corner, such that the corner may be replaced by a side that is substantially parallel to the hypotenuse and may be a length of 0.71 inches.

Rear side 238 of frame 204 may have rear left post 250, rear right post 252, and rear cross rail 254. In this illustrative example, rear side 238 may be an example of one implementation of rear side 148 in FIG. 1. Each rear post may be one-inch square tubing that is 32 13/16 inches long. Each rear post may be connected to a first and second end of rear cross rail 254 respectively. Rear cross rail 254 may be of a material, dimension, and length equal to front top cross rail 240 and front base cross rail 242. Rear cross rail 254 may be connected to rear posts so as to be substantially parallel to front top cross rail 240 and substantially perpendicular to each rear post.

Frame 204 may have right base cross beam 256, right central cross beam 258, and right top cross beam 260 each being connected at a respective front end to front right post 246. In this illustrative example, right base cross beam 256, right central cross beam 258, and right top cross beam 260 may be an example of one implementation of right base cross beam 176, right central cross beam 178, and right top cross beam 180 in FIG. 1. Frame 204 may also have left base cross beam 262, left central cross beam 264, and left top cross beam 266, each cross beam being connected at a respective front end to front left post 244. In this illustrative example, left base cross beam 262, left central cross beam 264, and left top cross beam 266 may be an example of one implementation of left base cross beam 168, left central cross beam 170, and left top cross beam 172 in FIG. 1.

All cross beams may be constructed as one-inch square tubing. A respective front end and rear end of left base cross beam 262 and right base cross beam 256 may each be cut substantially perpendicular to a length of the respective cross beam. The length of left base cross beam 262 and of right base cross beam 256 may each be 33 inches. The respective rear end of right base cross beam 256 and left base cross beam 262 are each respectively connected to rear right post 252 and rear left post 250. Left base cross beam 262, right base cross beam 256, and front base cross rail 242 may form a base of frame 204 that may serve to contain cart 202 from moving out from under front or sides of frame 204. Cart 202 may be rolled into the base from rear side 238 of frame 204, which may lack a rear base rail.

A respective rear end of right top cross beam 260, left top cross beam 266, right central cross beam 258, and left central cross beam 264, may each be cut substantially perpendicular to a length of the respective cross beam. A respective front end of right top cross beam 260, left top cross beam 266, right central cross beam 258, and left central cross beam 264 may all be cut with substantially the same inclination angle (not shown), which is inclined inward toward the rear end of the respective cross beam from a line perpendicular to the length of the cross beam. The inclination angle may be the angle at which cross beams rise from the front side 234 to the rear side 238 relative to the horizon. The longest length of each central and top cross beam may be equal to the length of each base cross beam. The front end of left top cross beam 266, left central cross beam 264, right top cross beam 260, and right central cross beam 258 may be connected flush against a respective front post such that the respective cross beam may rise above a horizontal line at the inclination angle such that the respective rear end of each respective cross beam may connect flush against respective rear left angle brace 268 and rear right angle brace 270.

Rear left angle brace 268, rear center angle brace 272 and rear right angle brace 270 each may have a respective rear post end and a top end. In this illustrative example, rear left angle brace 268, rear center angle brace 272, and rear right angle brace 270 may be an example of one implementation of rear left angle brace 160, rear center angle brace 164, and rear right angle brace 162 in FIG. 1. Each respective rear angle brace rear post end may be cut with an inclination angle substantially the same angle as the inclination angle of front ends of each central and top cross beam. The inclination angle may be cut inclined inward toward the top end of the respective rear angle brace from a line perpendicular to the length of the respective rear angle brace. Each rear angle brace may be constructed of one-inch square tubing that is 6 9/16 inches long on its longest side. Rear center angle brace 272 may be formed with the same dimensions and shape as rear left angle brace 268 and rear right angle brace 270.

The rear post end of rear left angle brace 268 may connect flush on top of rear left post 250 such that rear left angle brace 268 may extend upward, and toward front side 234 relative to vertical at the inclination angle. The rear post end of rear right angle brace 270 may connect flush on top of rear right post 252 such that rear right angle brace 270 may extend upward, and toward front side 234 relative to vertical at the inclination angle. The rear post end of rear center angle brace 272 may connect flush to a top side of rear cross rail 254 such that rear center angle brace 272 may extend upward, and toward front side 234 relative to vertical at the inclination angle.

Frame 204 may also have center central cross beam 274 and center top cross beam 276. In this illustrative example, center central cross beam 274 and center top cross beam 276 may be an example of one implementation of center central cross beam 147 and center top cross beam 145 in FIG. 1. Center central cross beam 274 may be formed to the same dimensions and shape as left central cross beam 264 and right central cross beam 258. Center top cross beam may be formed to the same dimensions and shape as left top cross beam 266 and right top cross beam. Center top cross beam may be located directly above center central cross beam 274. A rear end of center top cross beam 276 may connect to a front side of rear center angle brace 272 and a front end of center top cross beam 276 may connect flush to a rear side of front top cross rail 240. A rear end of center central cross beam 274 may connect to front side of rear center angle brace 272 and a front end of center central cross beam 274 may connect to front central cross rail 248. The center central cross beam 274 connections may be flush connections. Center central cross beam 274 and top central cross beam 276 may be substantially parallel to, and may rise at the inclination angle relative to horizontal, similar to right central cross beam 258 and right top cross beam 260. Both central cross beams may connect to front side 234 to align with front center vertical tube 278.

Front center vertical tube 278 may be one-inch square tubing. A top end and a bottom end of front center vertical tube 278 may be cut substantially perpendicularly to a length of front center vertical tube 278. The respective ends of front center vertical tube 278 may connect respectively to a bottom side of front top cross rail 240 and a top side of front central cross rail 248 at a midpoint on the front cross rails between front left post 244 and front right post 246. The center vertical tube 278 may be 6⅛ inches long.

Front panel 206 may connect to front side 234 of frame 204. Front panel 206 may be decorative, and may restrict access to, and visibility of, any product stored on cart 202. Front panel 206 may connect to front side 234 of frame 204. In this illustrative example, front panel 206 may be an example of one implementation of front panel 124 in FIG. 1. Front panel 206 may connect to front side 234 of frame 204 via gusset 280. Front panel 206 may be any material. Front panel 206 may be durable and composed of a wood or wood finish facing away from frame 204. A wood grain of the wood finish may align vertically. Front panel 206 may connect to front side 234 of frame 204 by connecting to gusset 280 on front side 234 of frame 204.

Front panel 206 may be capped with top rail 286. In this illustrative example, top rail 286 may be an example of one implementation of top rail 182 in FIG. 1. Top rail 286 may overhang front top cross rail 240 of front side 234 of frame 204. Top rail 286 may be reinforced to support the product container. Top rail 286 may be configured to facilitate sliding the product container onto support panel 184 connected to frame 204. Top rail 286 may be a different material than front panel 206. Top rail 286 may be configured to be durable and moisture resistant. Top rail 286 may be made with a plastic wood.

In an illustrative embodiment, at least two adjustment panels 208 and 210 may connect to frame 204. In this illustrative example, adjustment panels 208 and 210 may be an example of one implementation of number of adjustment panels 128 in FIG. 1. Each adjustment panel 208 and 210 may be formed to engage front side 234 and rear side 238 of frame 204. Adjustment panel 210 may be formed such that a bottom length and a top length of each adjustment panel 208 and 210 respectively, may rise from front side 234 to rear side 238 at the inclination angle above the horizontal. Each adjustment panel 208 and 210 may mount to frame 204 with a width of each adjustment panel 208 and 210 substantially vertical, and a length of each adjustment panel 208 and 210 substantially parallel to any adjacent adjustment panel. Each adjustment panel 208 and 210 may have a serpentine slot similar to serpentine slot 288 shown in adjustment panel 226. In this illustrative example, serpentine slot 288 may be an example of one implementation of number of serpentine slots 184 in FIG. 1. At least two serpentine slots in each adjustment panel 208 and 210 may be present to engage a product support 212, which will be described further below for FIG. 4.

Product support 212 may engage with a first adjustment panel 208 and a second adjustment panel 210. A distance of product support 212 from a top edge of serpentine slot may be adjusted as described further below for FIG. 4 and FIG. 7. Each product support 212 may connect to support panel 214. In this illustrative example, support panel 214 may be an example of one implementation of support panel 198 in FIG. 1. Support panel 214 will be further described below for FIG. 5. Each adjustment panel 208 and 210 may be capped with an adjustment panel cap such as adjustment panel cap 216. In this illustrative example, assembled panel cap 216 may be an example of one implementation of adjustment panel cap 192 in FIG. 1. Adjustment panel cap 216 may be made of a durable and moisture resistant material. Adjustment panel cap 216 may be able to support a product container and facilitate sliding the product container onto product support 212 when product support 212 may be engaged to adjustment panel 210, and retard deformation to adjustment panel 210. Adjustment panel cap 216 may be of the same material as top rail 286.

Figure 3:
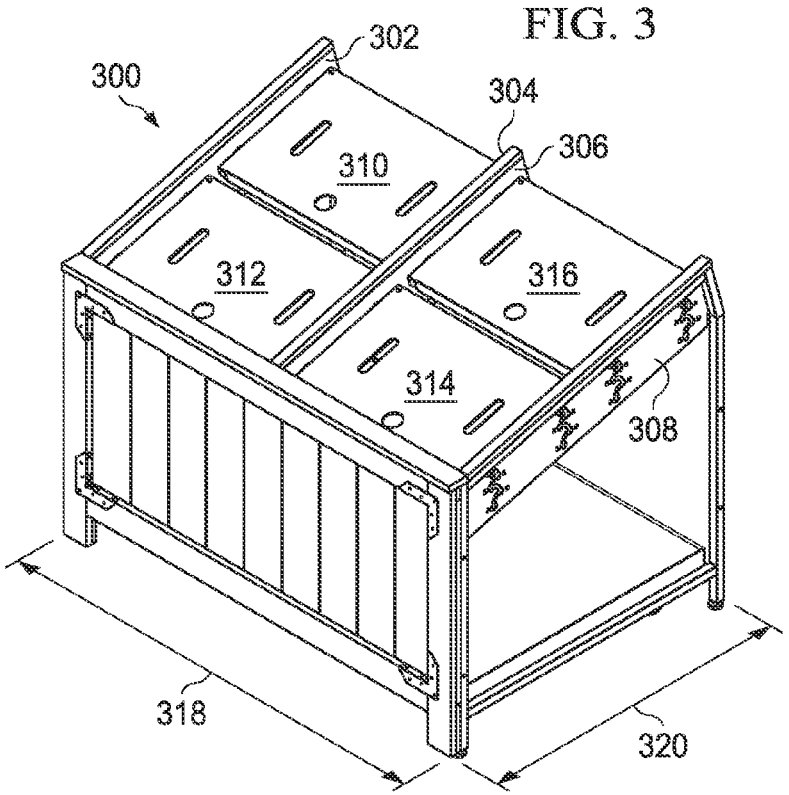
FIG. 3 is a perspective view illustration of an assembled product display system in accordance with an advantageous embodiment.

Turning now to FIG. 3, FIG. 3 shows a perspective view illustration of assembled product display system 300 in accordance with an advantageous embodiment. In this illustrative example, assembled product display system 300 may be an example of one implementation of exploded product display system 200 in FIG. 2 or of product display system 100 in FIG. 1. Although the illustration shows four adjustment panels 302, 304, 306, and 308 and four support panels 310, 312, 314, and 316 it is understood that the dimensions of the apparatus can be modified to accommodate a variable number of adjustment panels supporting a variable number of support panels. As a non-limiting example, length 318 of the product display system 300 may be approximately doubled to hold eight adjustment panels and eight support panels. In another non-limiting example, width 320 of the product display system 300 may be increased to hold six product supports in four adjustment panels of greater length than those shown in FIG. 3.

Figure 4:
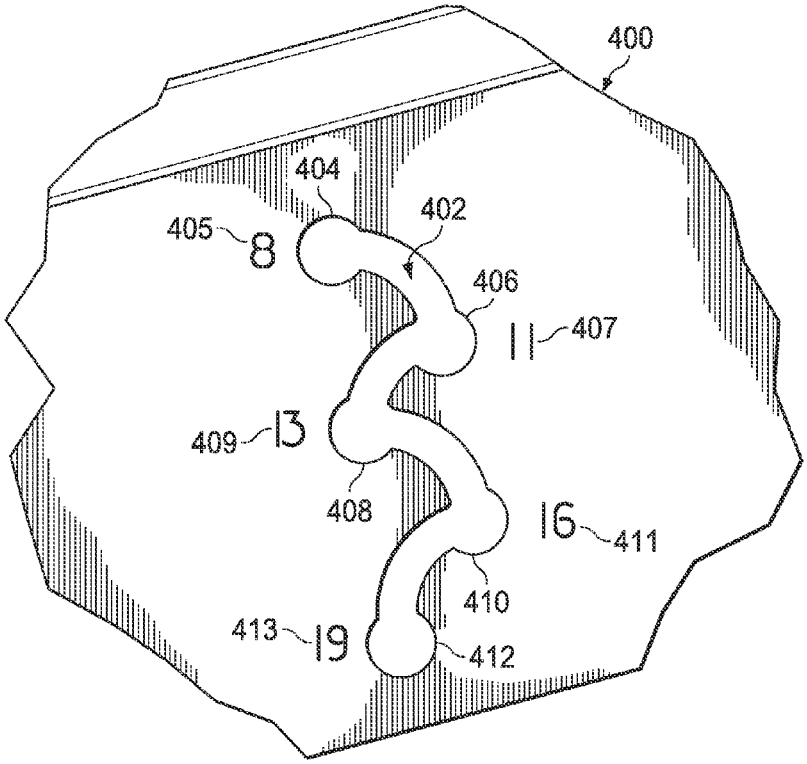
FIG. 4 is a side view illustration of a serpentine slot in a adjustment panel in accordance with an advantageous embodiment.

Turning now to FIG. 4, FIG. 4 shows a side view illustration of serpentine slot 402 in adjustment panel 400, in accordance with an advantageous embodiment. In this illustrative example, adjustment panel 400 and serpentine slot 402 may be an example of one implementation of adjustment panel 226 and serpentine slot 288 in FIG. 2 or one of number of adjustment panels 128 and number of serpentine slots 184 in FIG. 1. Serpentine slot 402 is illustrative of any serpentine slot that may be located in adjustment panel.

Adjustment panel 400 may be formed from any material suitable to support the weight of containers and products intended to be displayed upon each product support 194 (not shown) engaged with the adjustment panel 400. Adjustment panel 400 may include 12 gauge sheet metal. Adjustment panel may have a front edge and a rear edge that are notched to engage respective cross rails (shown in greater detail in FIG. 7). Adjustment panel 400 may be connected to a part of frame 204 (see FIG. 2). Adjustment panel 400 may be welded to a part of frame 204. A top length edge of adjustment panel 400 may connect to a top cross beam. A bottom length edge of adjustment panel 400 may connect to a central cross beam. Each adjustment panel 400 may have at least two serpentine slots. As shown for the embodiment in FIG. 2, each adjustment panel 216 may have four serpentine slots. A larger size frame 204 and adjustment panel 400 may contain a larger, even numbered total of serpentine slot 402. Each serpentine slot 402 may extend across a width of adjustment panel 400 and each serpentine slot 402 may include notch 404, 406, 408, 410, and 412.

In this illustrative example, notch 404 may be an example of one implementation of one of number of notches 186 in FIG. 1. Notch 404 may be formed to retain support pin 526 (not shown, see FIG. 5) extending from product support 502 (not shown, see FIG. 5). Notch 404 may be placed at various distances from a top edge of adjustment panel 400. A curvature for serpentine slot 402 may be chosen based on the inclination angle of the cross beams and a desired display angle for product support 502. Each notch 404 in a first serpentine slot is labeled with respective depth number 405 to indicate a depth of a selected product container that is best suited for display when product support pin 526 placed in selected notch corresponding to the depth of the selected product container. In this embodiment, five notches, 404, 406, 408, 410, and 412 are shown. Next to each notch is a different depth number 405, 407, 409, 411, and 413 associated with each respective notch to indicate settings for product containers of different depths. Depth number 405 ("8" in this embodiment) may be permanently marked on adjustment panel 400. Depth number 405 may be etched into adjustment panel 400. Depth number 405 may be engraved into adjustment panel 400.

A second serpentine slot (not shown) may have a similar quantity of notches as the first serpentine slot. Notches in the second serpentine slot may have depth number 405, 407, 409, 411, 413 corresponding to depth number 405, 407, 409, 411, 413 in the first serpentine slot to indicate proper notch 404 in second serpentine slot to engage a second support pin 542 (as shown in FIG. 5) extending from the same side of the product support 502 (as shown in FIG. 5) as support pin 526.

Each support pin 526 may move from one notch to another within its respective serpentine slot 402, without removing the product support 502 from serpentine slot 402. By moving all four support pins extending from product support 502 down to a lower level of notches, such as from notch 404 down to notch 408, the height, of a top edge of the selected product container, resting on product support 502, above a top edge of adjustment panel 400 may be lowered.

Accordingly, by selecting which notch 404, 406, 408, 410, and 412 will retain support pin 526 for product support 502 (see FIG. 5), a number of product containers of varying depths can each be located on a number of product supports within frame 204, yet the top edge of each product container may be substantially level with the respective top edge of all other product containers supported on frame 204. Additionally, support pins and thus product support 502 may be disengaged from the serpentine slot 402. Disengaging product support 502 from serpentine slot 402, and thus adjustment panel 400, may allow cleaning or repair of product support 502 and any connected elements.

Turning now to FIG. 5, FIG. 5 shows an exploded perspective view illustration of support assembly 500 including product support 502 and support panel 504 in accordance with an advantageous embodiment. In this illustrative example, product support 502 may be an example of one implementation of product support 212 in FIG. 2 or of product support 194 in FIG. 1. Support panel 504 may be an example of one implementation of support panel 214 in FIG. 2 or support panel 198 in FIG. 1. Support panel 504 may connect to product support 502. Support panel 504 may connect to product support 502 by inserting pop rivet 506, 508, 510, and 512 through support panel 504 into product support 502. Each pop rivet 506, 508, 510, and 512 may be a 0.187 by 0.375 size pop rivet.

Product support 502 may have a rectangular shape including front length tube 514, rear length tube 516, left side tube 518, and right side tube 520. All tubes defining product support 502 may be made from any material sufficient to support a product that will be placed upon the product support 502. All defining product support 502 may be made of one-inch square tubing. Front length tube 514 and rear length tube 516 may be 23 9/16 inches long. Left side tube 518 and right side tube 520 may be 13½ inches long. Grip tube 522 and 524 may be identically sized to the right side tube 520 and may each connect to front length tube 514 and rear length tube 516 at a distance of 4 5/16 inches from the left side tube 518 and the right side tube 520 respectively. Each grip tube 522 and 524 may be substantially parallel to the left side tube 518.

In an illustrative embodiment, product support 502 may have support pin 526 attached that may have engagement end 528 protrude from an outside edge of product support 502 along a width side, such as right side tube 520, of product support 502. In this illustrative example, support pin 526 may be one embodiment of number of support pins 196 in FIG. 1. Support pin 526 may have a washer 531 around support pin 526. Washer 531 may be connected to the outside edge of product support 502 along the width side, such as right side tube 520, of product support 502. Washer 531 may have a 1½ inch diameter. Washer 531 may include 12 gauge sheet metal. Engagement end 528 may protrude from a surface of washer 531, which is not touching the outside edge of product support 502, by ½ inch.

Support pin 526 may have a weld end 530 that is connected through a respective side tube and to an inner edge of the respective side tube. Weld end 530 may extend through an inside edge of the respective side tube and protrude in toward the grip tube. Support pin 526 may be ⅜ inch diameter and 1¾ inches long. Weld end 530 may protrude in toward the grip tube 524 by ⅛ inch. Weld end 530 may be tack welded to an inner edge of the side tube. Support pin 526 may penetrate respective side tube two inches in from an end of the side tube, and at a midpoint between a bottom edge and a top edge of a length side of the respective side tube.

Product support 502 may also have support lip 532 attached to front length tube 514. Support lip 532 may extend upward along the front length of front length tube 514 such that movement of a product container placed on support panel 504 down beyond a front edge of front length tube 514 may be restrained. A top edge of support lip 532 may be 3/16 of an inch above a top edge of front length tube 514. Support lip 532 may be 1⅜ inches wide. Support lip 532 may be a length that is less than a length of product support 502.

Support lip 532 may be recessed one inch from the end of product support 502. Support lip 532 may be 21 9/16 inches long. Support lip 532 may be made of any material that will prevent a fully loaded product container from sliding toward front side 234, past the front edge of front tube. Support lip 532 may include a 16 gauge steel sheet.

Support lip 532 may connect to product support 502 such that each end of the length of support lip 532 is recessed from a respective end of front length tube 514 by a distance that will allow a frame top insert (not shown) or a bulk produce top (not shown) to rest directly upon support panel 504 directly above front length tube 514, near an end of front length tube 514.

A frame top insert (not shown) may cover a first product support 310 (as shown in FIG. 3) and a second product support 312 (as shown in FIG. 3). A base of the frame top insert may rest upon end portions of front length tube 514 that do not have support lip 532 extending upward. The frame top insert may have a forward wall that extends upward, substantially orthogonally from a planar surface of the top frame insert and toward the front side 234 of the frame 204 (see FIG. 2) substantially parallel to the rear angle braces, and contacts substantially one-half the length of the top rail 286 of the front panel 206 (see FIG. 2). A bulk produce top may be a single insert that may cover four adjacent product supports 310, 312, 314, and 316 (as shown in FIG. 3). A base of the bulk produce top may rest upon end portions of front length tube 514 that do not have support lip 532 extending upward. The bulk produce insert may have a forward wall that extends upward, substantially orthogonally from a planar surface of the frame top insert and toward the front side 234 of the frame 204 substantially parallel to the rear angle braces, and contacts substantially the entire length of the top rail 286 of the front panel 206.

Support panel 504 may be a panel configured to dimensions equal to dimensions of the product support 502. Support panel 504 may be made from any material sufficient to support a product that will be placed upon the product support 502. Support panel 504 may include plastic. Support panel 504 may include acrylonitrile butadiene styrene. Support panel 504 may be 15½ by 23⁹⁄₁₆ inches. Support panel 504 may be ³⁄₁₆ inch thick. Support panel 504 may include at least two grip openings 534 and 536.

Grip openings may be openings through a thickness of support panel 504. Grip openings may allow human fingers or a lifting tool to pass through support panel 504 and engage grip tube 522 and/or 524. Support panel 504 may include drainage opening 538 near support panel 504 front edge 540. Support panel 504 front edge 540 may be an edge of support panel 504 that is closest to front side 234. Support lip 532 may connect to front edge 540.

Drainage opening 538 may be 2 inches in diameter. Drainage opening 538 may be an opening through a thickness of support panel 504. Drainage opening 538 may allow moisture from a product container to pass through support panel 504. Moisture may pass through support panel 504 with a drainage hose extending from the bottom of the product container to be placed onto support panel 504 so that the bottom of the product container sits substantially flat on support panel 504. A product container with the drainage hose extending from the bottom of the product container may be an ice bin. The ice bin may have a planform larger than a combined planform of two adjacent support panels. The ice bin may be a standard sized ice bin. The ice bin standard size may be 8 centimeters deep. The drainage hose (not shown) may be run through drainage opening 538. A drainage receptacle may be placed on cart 202 below product support 502. The drainage receptacle may be a five gallon bucket.

Figure 6:
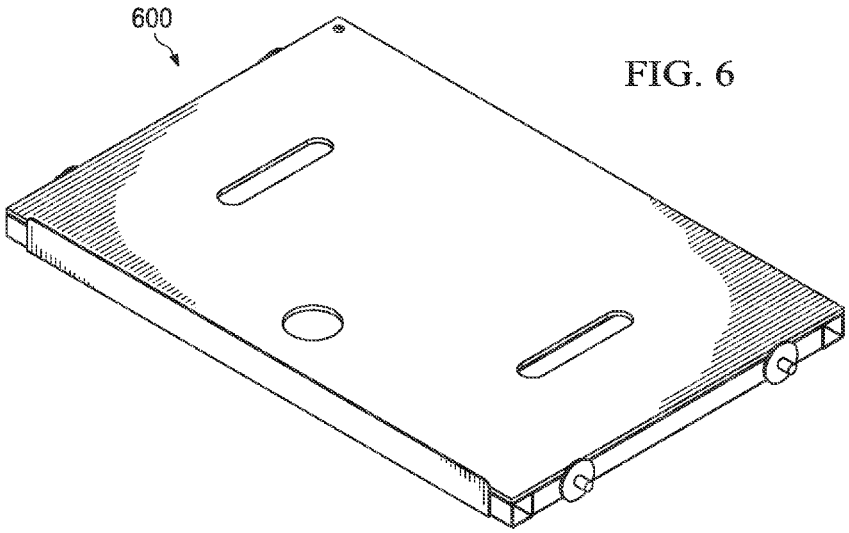
FIG. 6 is a perspective view illustration of a support assembly in accordance with an advantageous embodiment.

Turning now to FIG. 6, FIG. 6 shows a perspective view illustration of support assembly 600 in accordance with an advantageous embodiment. In this illustrative example, support assembly 600 may be an example of one implementation of support assembly 500 in FIG. 5, or of support assembly 126 in FIG. 1. Support assembly 600 may be loaded into number of adjustment panels 128 such that no support assembly 600 directly contacts any other support assembly 600 loaded on number of adjustment panels 128 on the same display stand 104.

Figure 7:
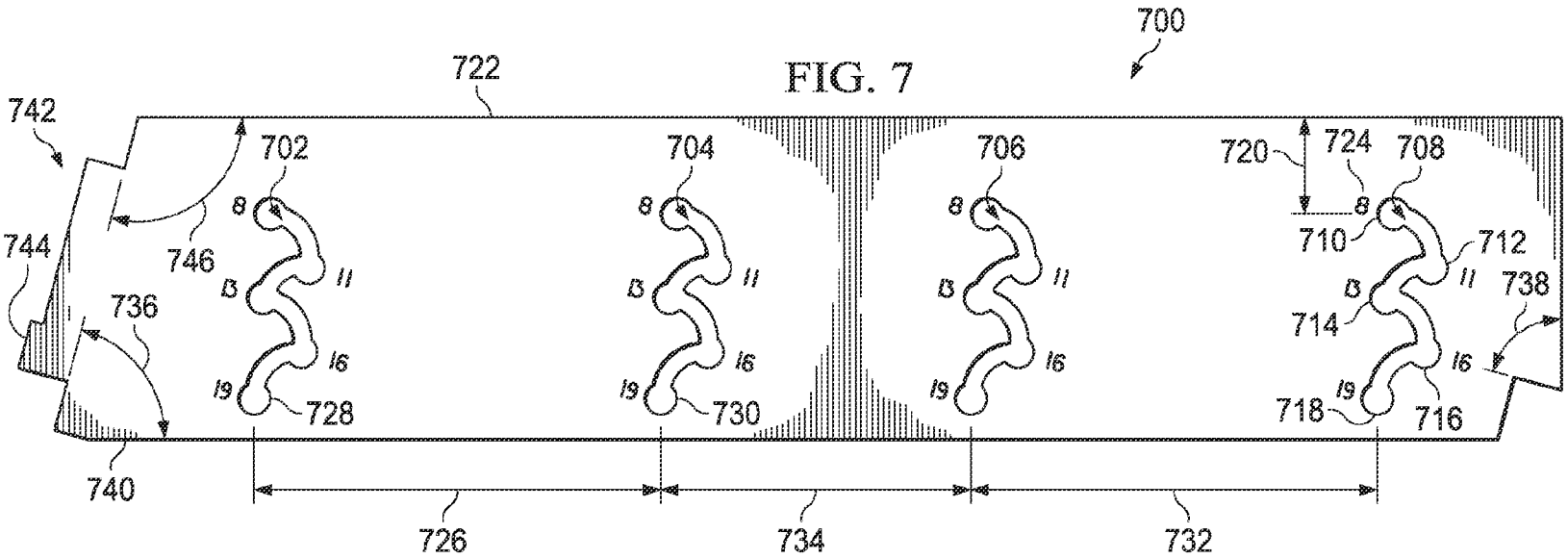
FIG. 7 is a side view illustration of an adjustment panel in accordance with an advantageous embodiment.

Now turning to FIG. 7, FIG. 7 is a side view illustration of adjustment panel 700 in accordance with an advantageous embodiment. In this illustrative example, adjustment panel may be an example of one implementation of adjustment panel 208 in FIG. 2, adjustment panel 308 in FIG. 3, adjustment panel 400 in FIG. 4, or of one adjustment panel in number of adjustment panels 128 in FIG. 1.

More than one serpentine slot 702, 704, 706, and 708 may be cut through adjustment panel. Dimensions and shapes of each serpentine slot may be identical to all other serpentine slots on the same adjustment panel 700. Dimensions and shapes of each serpentine slot may be identical to all other serpentine slots on number of adjustment panels 128 connected to a particular support panel 198. Adjustment panel 700 may have at least two serpentine slots. Each serpentine slot may have notches. Some number of notches may be located in each serpentine slot such that there is a notch 710 and 718 at each end of the serpentine slot, and a notch 712, 714, and 716 at each location where the slot direction changes.

Each serpentine slot 702, 704, 706, 708 may be wide enough to engage one support pin, such as support pin 526 in FIG. 5. Notch 710, may be deep enough to engage one support pin such that, when adjustment panel 700 is mounted on frame 204 (see FIG. 2), the support pin 526 will not slide out of notch 710 and into serpentine slot 708 until the support pin is intentionally raised up to disengage from notch 710 and the support pin slides through serpentine slot 708 to another notch such as notch 712, 714, 716, and 718. A depth distance 720 from a top edge 722 of adjustment panel 700 to notch 710 may correspond to a depth of a standard sized container that may be placed on a support assembly, such as support assembly 600 in FIG. 6, which has support pin 526 engaged in notch 710. Depth number 724 representing the depth of the standard sized container may be marked onto adjustment panel 700 adjacent to notch 710, as similarly described in FIG. 4.

When a support assembly has two support pins extending from each side of the support assembly, such as support pin 526 and 542 on product support 502 in FIG. 5, then adjustment panel 700 may have an even number of serpentine slots 184. Slot separation distance 726 between notches with corresponding depth number, such as notch 728 and 730, both marked with a "19," will be equal to the distance between support pins (such as the distance between support pin 526 and support pin 542 in FIG. 5) on the side of the support assembly 500 engaged in serpentine slot 702 and 704. Notches in serpentine slot 706 may have a slot separation distance 732 similarly formed to slot separation distance 726. Slot spread 734 must be sufficient to preclude a back side of a container on a first product assembly engaged with serpentine slot 704 from contacting the front of a second product assembly engaged with serpentine slot 706.

Adjustment panel 700 front edge 742 may be shaped to engage a bottom edge of a front top cross rail 240 and a top edge of a front central cross rail 248, as shown in FIG. 2. Tab 744 extends forward from front edge to contact a front post underneath a gusset 280 connected to the front post. Angle 746 may be 90 degrees greater than the inclination angle. Angle 736 and angle 738 may each be complimentary to the inclination angle. The inclination angle may be the angle at which bottom edge 740 of adjustment panel rises relative to horizontal when the adjustment panel is mounted on frame 204 as in FIG. 2. The inclination angle may be 15 degrees. An inclination angle of 15 degrees may allow convenient access to a product on support assembly 126 on frame 122 by a stocker standing on the rear side 148 of the frame 122.

In operation, a stocker may retrieve food containers from a storage area by stacking or sliding them onto cart 114. Cart 114 may be rolled to frame 122. A depth of a product container to be loaded may be determined. By reaching through grip openings, the stocker can lift product support 194 and place product support 194 into a first and adjacent second serpentine slot on a first adjustment panel, such as adjustment panel 208 in FIG. 2, by inserting a first and second support pin into the first and second serpentine slots respectively. Stocker can then place a third and fourth support pin into a third and fourth serpentine slot respectively on a second adjustment panel, such as adjustment panel 210 in FIG. 2.

When product support 194 is in the first and the second serpentine slots, the stocker may slide support assembly 600 through the serpentine slots to place all support pins into respective number of notches 186 in the respective number of serpentine slots 184. Each notch selected may have a similar depth number 188 marking it, the depth number 188 corresponding to a depth of the product container resting on the product support 194. In an illustrative embodiment, for an 8 centimeter deep reusable plastic container, each support pin may be engaged in a notch with depth number 188 labeled "8." If the 8 centimeter deep reusable plastic container is then to be replaced on frame 122, with a different reusable plastic container that may be 13 centimeters deep, then a stocker can reach through the grip openings, lift the support assembly 600 up to disengage each of four support pin's from their respective notches (each labeled "8"), and slide the support assembly 600, with each support pin remaining in its respective serpentine slot, downward to engage each of its four support pins into respective notches, in their respective serpentine slots, that may each have a depth number 188 labeled 13.

Regardless of the notch selected for each support assembly 126, in the illustrative embodiment (as shown in FIG. 3) four support assemblies may be loaded into two pairs of adjustment panels in such a configuration that, if the containers are standard sized reusable product containers commonly used to transport and display produce, regardless of each reusable product container's depth, sufficient space remains between each side of all the containers so that any particular container may be placed onto or removed from its respective support assembly 126 without engaging or being hindered by any of the other containers on their respective product supports. The support lip 199 on a front side of the support assembly 126 serves to prevent a container placed on the support assembly from sliding down and contacting an adjacent container.

The description of the different illustrative embodiments has been presented for purposes of illustration and description and is not intended to be exhaustive or limited to the embodiments in the form disclosed. Dimensions provided in this specification may be for an illustrative embodiment, and are not restrictive or exclusive. Many modifications and variations will be apparent to those of ordinary skill in the art. Further, different illustrative embodiments may provide different advantages as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method of displaying a first container and a second container, the method comprising:

identifying a first display height for a first product support;

identifying a second display height for a second product support;

connecting adjustment panels to a frame, each adjustment panel comprising at least two serpentine slots, wherein each serpentine slot comprises at least two notches;

engaging first support pins of the first product support into first notches and second support pins of the second product support into second notches; and receiving the first container on the first product support and the second container on the second product support;

wherein the first container has a first depth and the second container has a second depth;

wherein first notches align the first product support and second notches align the second product support so that a first top edge of the first container is substantially level with a second top edge of the second container.

2. The method of claim 1, further comprising producing a cart, the cart comprising a rectangular shape, configured to receive, from a first side of the cart, a product container onto a planar surface connected to a top side of the cart, the first side defining a length of the rectangular shape, the cart further comprising, on each of the three remaining sides of the cart, a container retention lip extending vertically upward above the planar surface, and configuring the cart to transport the product container from a storage area to the frame.

3. The method of claim 2, further comprising attaching a mobility system and a braking system to the cart, the mobility system comprising a caster, the braking system comprising a caster brake.

4. The method of claim 1, further comprising forming each serpentine slot such that it comprises at least five notches each of the at least five notches retaining the product support at least five different distances from a top edge of the adjustment panel.

5. The method of claim 4, further comprising:

marking each of the at least five notches with a different numeral, each numeral corresponding to a different height of a different container.

6. The method of claim 1, further comprising wherein a desired display angle determines an inclination angle used for cutting and mounting each adjustment panel and a respective front end, identically cut, for each of: a center central cross beam, a center top cross beam, a left central cross beam, a right central cross beam, a left top cross beam, and a right top cross beam as well as a respective rear post end, identically cut, for each of: a rear center angle brace, a rear left angle brace, and a rear right angle brace.

7. The method of claim 1, further comprising, attaching a stem leveler/glide, to an end, nearest a floor that the frame stands on, of a post that is part of the frame.

8. The method of claim 1, further comprising spacing apart the adjustment panels such that a distance between a first adjustment panel and a second adjustment panel accommodates inserting a standard sized produce plastic container onto a support engaging the first adjustment panel and the second adjustment panel.

9. The method of claim 1, further comprising covering each adjustment panel with a cap.

10. The method of claim 1, further comprising cutting:

openings in each support panel such that at least two openings are configured to allow fingers to pass through the openings to engage a grip tube of the product support beneath the support panel; and a drainage opening near a length side of the panel closest to a front side of the frame.

11. The method of claim 1, wherein the first notches retain the first support at a first distance from a first adjustment panel top edge and second notches retain the second support at a second distance from a second adjustment panel top edge.

12. A method for displaying products, the method comprising:

providing a display having a first product support and a second product support;

engaging first pins of a first product support into first notches in first serpentine slots of at least two first adjustment panels, each of the first notches corresponding to a first depth;

engaging second pins of a second product support into second notches of at least two second adjustment panels, each of the second notches marked to correspond to a second depth;

placing a first container having the first depth into the first product support; and placing a second container having the second depth into the second product support;

wherein the first notches align the first product support and the second notches align the second product support so that a first top edge of the first container is substantially level with a second top edge of the second container.

* * * * *